US012799849B2

(12) United States Patent
Long et al.

(10) Patent No.: US 12,799,849 B2
(45) Date of Patent: Nov. 17, 2026

(54) DOWNHOLE COMPLETION AND METHOD OF MANUFACTURING THE SAME

(71) Applicant: SHELL USA, INC., Houston, TX (US)

(72) Inventors: Xin Long, Houston, TX (US); Stephen Hicking, Aberdeen (GB); Xiaohui Xiao, Houston, TX (US); Andrew Gordon Tallin, Sugar Land, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 19/269,350

(22) Filed: Jul. 15, 2025

(65) Prior Publication Data

US 2026/0022623 A1 Jan. 22, 2026

Related U.S. Application Data

(60) Provisional application No. 63/672,777, filed on Jul. 18, 2024.

(51) Int. Cl.
*E21B 43/08* (2006.01)

(52) U.S. Cl.
CPC ..... *E21B 43/088* (2013.01)

(58) Field of Classification Search
CPC ..... E21B 43/088
See application file for complete search history.

(56) References Cited

U.S. PATENT DOCUMENTS 3,331,441 A * 7/1967 Sweeney ..... E21B 43/088 166/234
3,578,029 A * 5/1971 Cullen ..... E21B 17/20 138/139
4,378,294 A * 3/1983 Wagner ..... B29D 1/005 210/497.1
4,416,331 A * 11/1983 Lilly ..... B01D 35/18 166/278
4,550,778 A * 11/1985 Sullivan ..... E21B 43/088 166/234

(Continued)

FOREIGN PATENT DOCUMENTS

CN 201152152 Y 11/2008
CN 201448099 U 5/2010

(Continued)

OTHER PUBLICATIONS

Elsevier, "Developments in Petroleum Science", Sand Control Screen Types, Section 3.4, 2009, vol. No. 56, pp. 166-170.

*Primary Examiner* — Shane Bomar
(74) *Attorney, Agent, or Firm* — SHELL USA, INC.

(57) ABSTRACT

In a downhole completion, a perforated base pipe, having a central longitudinal axis, is concentrically surrounded by a sand screen. The sand screen is bound by an upper extremity and a lower extremity. At least one of the upper extremity and the lower extremity is slidable. The downhole completion may be manufactured by providing a perforated base pipe having a central longitudinal axis; providing an assembly with a plurality of ribs extending between the upper extremity and the lower extremity along a helical rib path; and shrink-fit wrapping at least one screen wire on the plurality of ribs while the assembly is concentrically arranged on the perforated base pipe whereby at least one, preferably both, of the upper extremity and the lower extremity are slidable on the perforated base pipe.

20 Claims, 2 Drawing Sheets

(56) References Cited

U.S. PATENT DOCUMENTS 8,578,608 B2 * 11/2013 Roaldsnes ..... B21F 27/124 29/896.61
2002/0038707 A1 * 4/2002 Gillespie ..... E21B 43/084 166/233
2003/0173075 A1 * 9/2003 Morvant ..... E21B 43/08 166/236
2004/0262011 A1 * 12/2004 Huckabee ..... E21B 43/08 166/227
2007/0246226 A1 * 10/2007 Macias ..... E21B 43/04 166/227
2007/0295422 A1 12/2007 Ostan et al.
2011/0108477 A1 * 5/2011 Hammer ..... B01D 29/48 210/499
2012/0152528 A1 6/2012 Stephen
2012/0298223 A1 * 11/2012 Krush ..... E21B 43/08 137/544
2014/0262260 A1 * 9/2014 Mayer ..... E21B 43/088 166/278
2015/0034329 A1 * 2/2015 McGeoch ..... E21B 43/08 166/205
2015/0047837 A1 * 2/2015 Turner ..... E21B 43/12 166/254.2
2016/0258256 A1 * 9/2016 Nguyen ..... E21B 34/06
2017/0074077 A1 * 3/2017 Bowen ..... E21B 43/084
2017/0145796 A1 5/2017 Lejeune
2017/0159859 A1 6/2017 Claerhout et al.
2017/0211361 A1 * 7/2017 Reid ..... E21B 43/08
2017/0254185 A1 9/2017 Lange et al.
2019/0195052 A1 6/2019 Yi et al.
2022/0241709 A1 8/2022 Cox et al.
2022/0349291 A1 11/2022 Meschke et al.

FOREIGN PATENT DOCUMENTS

CN 103939061 A 7/2014
CN 113404444 A 9/2021

* cited by examiner

DOWNHOLE COMPLETION AND METHOD OF MANUFACTURING THE SAME

CROSS REFERENCE TO RELATED APPLICATIONS

This claims priority of U.S. Provisional Application No. 63/672,777 filed 18 Jul. 2024, which is incorporated herein by reference in its entirety

FIELD OF THE INVENTION

In a first aspect, the present invention relates to a downhole completion comprising a perforated base pipe along a central longitudinal axis, concentrically surrounded by a sand screen. In another aspect, the invention relates to method of manufacturing such a downhole completion.

BACKGROUND TO THE INVENTION

Frequently sand control strategies are applied in the production of natural oil and gas from subsurface wells. Some types of sand control require a screen in a downhole completion, which in essence provides a filter that blocks solids from the produced fluids. Examples of sand control screens are described in for example section 3.4 of Developments in Petroleum Science, Volume 56, 2009, Pages 166-170 (Elsevier).

It has been found that sand screens may be vulnerable to formation compaction induced deformation. This can be quite costly to remedy.

SUMMARY OF THE INVENTION

In accordance with the invention there is provided a downhole completion comprising a perforated base pipe having a central longitudinal axis, concentrically surrounded by a sand screen, said sand screen comprising an upper extremity and a lower extremity separated from each other in longitudinal direction, wherein at least one of the upper extremity and the lower extremity is slidable on the perforated base pipe.

In a further aspect, there is provided a method of manufacturing a downhole completion, such as the downhole completion defined in the previous paragraph, comprising:

- providing a perforated base pipe having a central longitudinal axis;
- providing an assembly comprising a plurality of ribs extending between the upper extremity and the lower extremity along a helical rib path; and
- shrink-fit wrapping at least one screen wire on the plurality of ribs, along a helical wire path having an opposite winding direction compared to the helical rib path, while the assembly is concentrically arranged on the perforated base pipe whereby at least one, preferably both, of the upper extremity and the lower extremity are slidable on the perforated base pipe.

These and other features, embodiments and advantages of the method, and of suitable expansion devices, are described in the accompanying claims, abstract and the following detailed description of non-limiting embodiments depicted in the accompanying drawings, in which description reference numerals are used which refer to corresponding reference numerals that are depicted in the drawings.

BRIEF DESCRIPTION OF THE DRA WINGS

The drawing figures depict one or more implementations in accordance with the present teachings, by way of example only, not by way of limitation. In the figures, like reference numerals refer to the same or similar elements.

Figure 1:
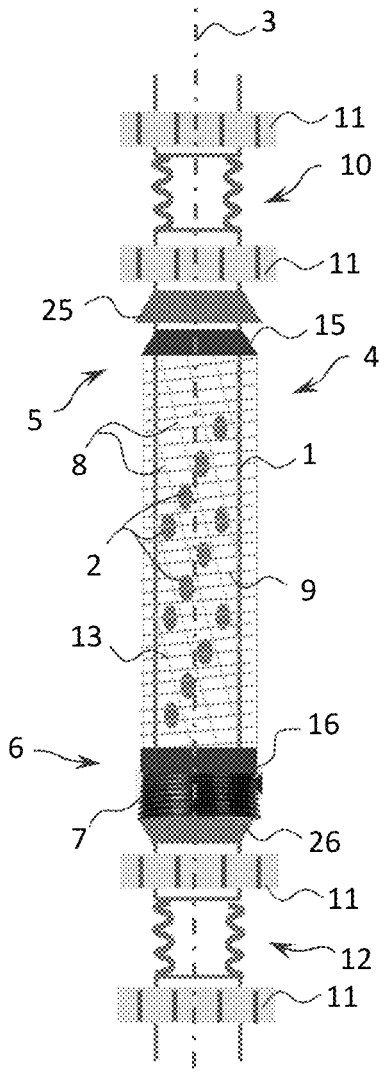
FIG. 1 shows a schematic side view of a downhole completion.

All views are schematic and not necessarily to-scale. Similar reference numerals in different figures denote the same or similar objects. Objects and other features depicted in the figures and/or described in this specification, abstract and/or claims may be combined in different ways by a person skilled in the art. Unless otherwise indicated, the term longitudinal is used herein to express the direction parallel to the central longitudinal tool axis, and the term transverse is used to express any direction normal (perpendicular) to the central longitudinal tool axis.

DETAILED DESCRIPTION OF THE INVENTION

Proposed is a novel compaction-resistant sand screen, which concentrically surrounds a perforated base pipe having a central longitudinal axis. The sand screen has an upper extremity and a lower extremity, separated from each other in longitudinal direction. At least one, preferably both, of the upper and lower extremities can slide on the perforated base pipe while being used in the well. Thanks to this slidability, the ingress of fluids and particularly solids via the extremities is avoided, while at the same time the sand screen is able to respond more freely to forces imposed by the formation or gravel pack with less stress caused by the base pipe. As a result, the sand screen does not buckle or break easily, and thus is capable of retaining its functionality under reservoir compaction deformation.

Preferably, at least one, or both, of the extremities is slidably in longitudinal direction. In addition, the one or both extremities may be rotationally slidable around the central longitudinal axis.

Suitably, the sand screen is a direct wire-wrapped screen. In such a sand screen, one or more wires have been shrink-fit wrapped onto a plurality of ribs that are distributed around the perforated base pipe. The shrink-wrapping generally causes a snug fitting between the ribs and the perforated base pipe, which allows for a certain amount of static friction between the sand screen and the perforated base pipe.

Suitably, the static friction is sufficiently small to avoid permanent deformation stress on the sand screen, yet sufficiently high to keep the sand screen in place even though the extremities are not longitudinally secured to the base pipe.

Two longitudinally separated stop rings may be secured to the perforated base pipe stationary thereto. In that case, the sand screen may suitably be sandwiched between these stop rings with some additional spacing in between to allow for sliding movement of one or both of the screen's extremities.

A gap between at least one of the lower extremity and the upper extremity and a nearest one of the two longitudinally separated stop rings may advantageously be shielded off by a compliant shroud. The longitudinal compliance of the shroud allows longitudinal movement between the extremity and the stop ring between which the shroud is located. The shroud serves to prevent solids from getting between the stop ring and the screen's extremity to ensure longitudinal movement of the screen is not hampered. Furthermore, the shroud may help to present solids from entering between the screen and the perforated base pipe through the extremity.

The resistance against compaction strain may further be enhanced by one or more optional auxiliary features.

One of these optional auxiliary features includes ribs that are follow a helical rib path around the perforated base pipe rather than a straight longitudinal rib path. The ribs extend between the upper extremity and the lower extremity along a helical rib path. Each screen wire follows a helical wire path in an opposite winding direction compared to the helical rib path. This provides a level of longitudinal compliance of the screen, as the ribs are at a non-zero angle with the longitudinal direction whereby any compressive strain translates in a slightly higher pitch of the helical rib path rather than stress building up within the ribs. This may facilitate a controlled longitudinal deformation of the screen, rather than a catastrophic collapse which might occur with conventional straight longitudinal ribs.

The rib paths of each of the ribs preferably extend parallel to each other. The screen wire(s), when connected to the ribs at their cross points, together with the ribs form parallelograms, which facilitate keeping the ribs equidistant to each other even when the sand screen is put under deformation. There are preferably no longitudinally aligned rigid connecting bridges between adjacent ribs or rib windings and/or wire(s), as such bridges would be vulnerable to buckling under longitudinal strain. The helically oriented ribs and wire(s), on the other hand, can take longitudinal strain by slightly torquing and compressing like helical springs.

To facilitate the construction of the sand screen, the sand screen may comprise an upper screen end ring at the upper extremity and a lower screen end ring at the lower extremity, whereby the ribs are connected to both the upper screen end ring and the lower screen end ring, following the helical rib path as described in the previous paragraph between the upper screen end ring and the lower screen end ring.

Another example of such optional auxiliary features includes a compaction compliance section in the base pipe above the sand screen, and optionally also below the sand screen. A common source of strain in the base pipe may be imposed by formation compaction over time during the production of oil and gas from the well. Compaction compliance sections connected to the base pipe can absorb a large amount of strain applied on the base pipe.

The perforated base pipe may typically comprise a section with perforations and a section with no perforations, wherein the section with no perforations is connected to such compaction compliance section. The compaction compliance section may comprise a corrugated wall section having corrugations in the longitudinal direction. Alternatively, the compaction compliance section may comprise a telescopic section that includes two opposing pipe ends mutually slidable relative to each other in the longitudinal direction. Such compliance section in the base pipe serves as a compliant buffer separating the perforated pipe section and/or the sand screen from pipes and formations above and/or below the sand screen. This buffer absorbs any strain rather than transmitting it to the perforated pipe section with the sand screen.

It will be understood by the person of ordinary skill in the art that the compliance buffer may also be applied in combination with other types of sand control tools such as packed screens, slotted screens or wire mesh screens.

Referring now to FIG. 1, there is illustrated a downhole completion. It comprises a base pipe 1 provided with a plurality of perforations 2. Although the invention is not limited to a particular sizing or material selection, a typical base pipe may measure 3.5" OD (8.89 cm) with a S13Cr110MY wall of 0.254" (6.4 mm) thickness. The base pipe 1 is centred around a central longitudinal axis 3. A sand screen 4 concentrically surrounds the perforated section of the base pipe 1. The sand screen 4 comprises an upper extremity 5 and a lower extremity 6. In the embodiment as shown, upper extremity 5 comprises an upper end ring 15 and the lower extremity comprises a lower end ring 16. The upper extremity 5 and the lower extremity 6 are slidable, at least in longitudinal direction.

The downhole completion of FIG. 1 further comprises an upper stop ring 25 and a lower stop ring 26. These are secured to the base pipe 1 (in a non-perforated section thereof) such that they are stationary at least in the longitudinal direction. Suitably, the stop rings may be welded to the base pipe 1. The stop rings provide upper and lower boundaries between which the sand screen 4 is movable. The sand screen 4 is arranged between these stop rings, with additional spacing in between the screen and at least one of the two stop rings, to allow for sliding movement of one or both of the screen's upper extremity and lower extremity. Mathematically, this may be translated to the lower extremity 6 and the upper extremity 5 are separated by a screen length L, while the two longitudinally separated stop rings 25 and 26 are spaced apart from each other in the longitudinal direction by a distance D, whereby D is larger than L.

Optionally, a compliant shroud 7 may be arranged between the lower end ring 6 and the lower stop ring 26. The shroud 7 is compliant to allow longitudinal movement between the lower extremity 6 and the lower stop ring 16. Instead of this shroud 7, or in addition thereto, a similar shroud may be arranged between the upper extremity 5 and the upper stop ring 25. Such optional shroud 7 may for example be manufactured out of rubber, elastomer, foam or a flexible polymer.

The sand screen 4 of FIG. 1 may comprise a plurality of ribs 8 adjacent to and in contact with the base pipe 1. The plurality of ribs 8 is surrounded by one or more sand screen wires 9 wrapped around the ribs 8.

Figure 2:
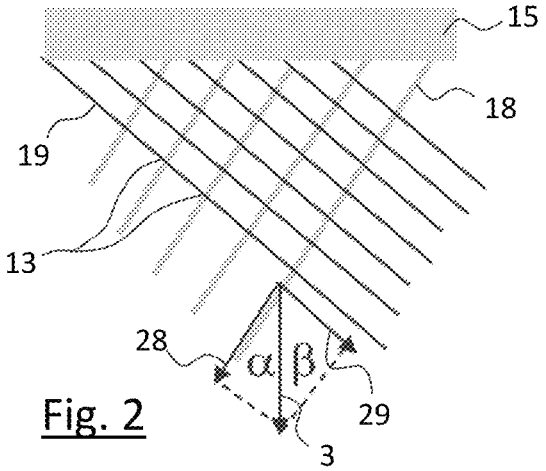
FIG. 2 shows a schematic closer view of the ribs and wires and their helical paths.

Each of the ribs 8 ribs extend between the upper extremity 5 and the lower extremity 6 along a helical rib path 18 (as indicated in FIG. 2). Each screen wire 9 follows a helical wire path 19. The helical wire path 19 has opposite helicity (winding direction) compared the helical rib path 18. One can for example be clockwise winding in downward direction while the other is counterclockwise. As clarified in FIG. 2, the helical rib path 18 has a rib helix angle $\alpha$ and the helical wire path 19 has a wire helix angle $\beta$. Helix angles herein are defined as smallest angle between the direction of a rib axis 28 or wire axis 29, and the longitudinal direction 3. For a cylindrical helical path with windings over a radius r (seen in transverse projection) in which one winding advances over a lead distance l, the helix angle can be expressed as arctan ($2\pi r/l$).

Suitably, the rib helix angle $\alpha$ is selected from a first helix angle range of from 10° to 60° (i.e. $10° \leq \alpha \leq 60°$). The wire helix angle $\beta$ may be selected from a second helix angle range of from 30° to 80° (i.e. $30° \leq \beta \leq 80°$). Suitably, the helical wire path 18 is chosen about perpendicular to the rib axis 28 at cross points 10 between any rib 8 and any screen wire 9. However, a deviation from perpendicular may be acceptable. Such deviation from perpendicular may be by at most 20°, preferably by at most 10°. In preferred embodiments, the first helix angle range is from 30° to 60° and/or the second helix angle range is from 30° to 60°. A larger a rib helix angle $\alpha$, especially above 30°, strongly facilitates the sand screen's ability to accommodate longitudinal strain without imposing too much compressive stress on the ribs 8.

Referring again to FIG. 1, the base pipe may be connected a compaction compliance section 10. One or more centralizers 11 may optionally be provided as well. A similar compliance section 12 may be provided below the base pipe as well. Typically, such compliance section may have a length of approximately 30 cm to 60 cm.

Figure 3:
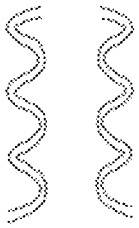
FIG. 3 shows a schematic representation of a compaction compliance corrugation according to a first embodiment.
Figure 4:
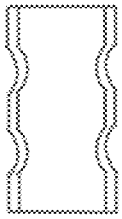
FIG. 4 shows a schematic representation of a compaction compliance corrugation according to a second embodiment.
Figure 5:
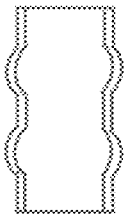
FIG. 5 shows a schematic representation of a compaction compliance corrugation according to a third embodiment.
Figure 6:
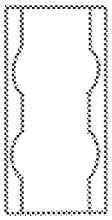
FIG. 6 shows a schematic representation of a compaction compliance corrugation according to a fourth embodiment.

The compaction compliance section may comprise a corrugated wall section having corrugations in the longitudinal direction. FIGS. 3 to 6 briefly illustrate various corrugation geometries that can be employed. FIG. 3 shows a wave corrugation, and FIG. 4 shows an inward corrugation. While these can function well to absorb strain and protect the base pipe 1 and sand screen 4 from strain transmitted from pipes above and/or below, they tend to restrict inner diameter. The embodiments of FIGS. 5 (an outward corrugation) and 6 (negative inward corrugation with straight outer contour) do not have to sacrifice inner diameter.

Figure 7:
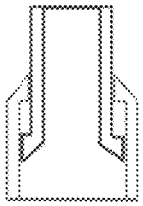
FIG. 7 shows a schematic representation of a compaction compliance telescopic construction.

Alternatively, the compaction compliance section may comprise a telescopic section comprising two opposing pipe ends mutually slidable relative to each other in the longitudinal direction. FIG. 7 show a schematic illustration of such telescopic design.

There are generally two types of wire-wrapped sand screens: slip-on and direct wrapped. While aspects of the invention can be implemented with either variant, the direct wire-wrapped screen may be preferred. As the extremities are free to slide, it is useful to have a snug fit between the sand screen 4 and the base pipe 1 to keep the sand screen assembly in place without the need for welding any part of the assembly on the perforated base pipe. This can be achieved by direct wrapping which generally involves shrink-fit wrapping of the screen wire(s).

Accordingly, the down hole completion described herein may be manufactured in accordance with a method which comprises at least the following steps:

- providing a perforated base pipe having a central longitudinal axis;
- providing an assembly comprising a plurality of ribs extending between the upper extremity and the lower extremity along a helical rib path; and
- shrink-fit wrapping at least one screen wire on the plurality of ribs, along a helical wire path having an opposite winding direction compared to the helical rib path, while the assembly is concentrically arranged on the perforated base pipe whereby at least one, preferably both, of the upper screen end ring and the lower screen end ring are slidable on the perforated base pipe, preferably at least in longitudinal direction.

Figure 8:
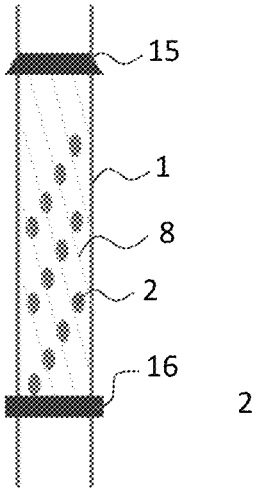
FIG. 8 shows a side view of a first stage of a first manufacturing sequence of a sand screen on a base pipe.
Figure 9:
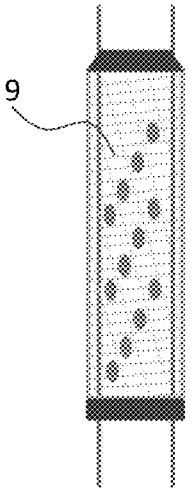
FIG. 9 shows a side view of a second stage of the first manufacturing sequence.
Figure 10:
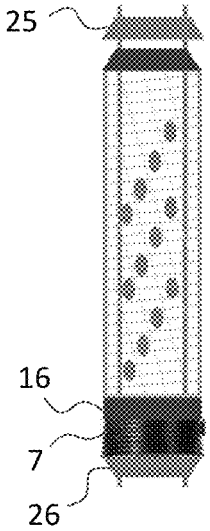
FIG. 10 shows a side view of a third stage of the first manufacturing sequence.

The method may be implemented in various ways (manufacturing sequences). Two examples will be discussed. FIGS. 8 to 10 illustrate steps of a first manufacturing sequence. FIG. 8 shows the perforated base pipe 1 after installing the upper end ring 15 and lower end ring 16 at the upper and lower extremities of the sand screen, respectively. The ribs 8 are connected, for example by welding, to the respective end rings 15 and 16. FIG. 9 shows the screen wire(s) 9 after installing by shrink-fit wrapping. Shrink-fit wrapping generally implies application of the screen wire(s) 9 at elevated temperature, causing contraction upon cooling down. This may cause a hoop stress (tension) in the screen wire(s) 9. The screen wire(s) 9 may be welded (suitably by resistance welding) onto the ribs 8 at cross points, whereby preventing rolling of the wire(s) and facilitating stabilizing of the wire(s) 9 and ribs 8 which is particularly of importance when the assembly is deforms under strain. Also, the wire end(s) may be connected to the respective end rings 15 and 16. In a subsequent stage, shown in FIG. 10, the optional compliant shroud is installed on the lower end ring 16. The end rings 15 and 16 remain slidable on the base pipe 1. The stationary upper stop ring 25 and lower stop ring 26 may be secured to the base pipe 1, for example by welding.

Figure 11:
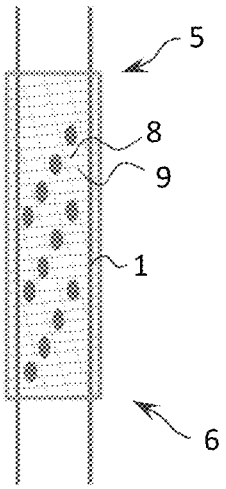
FIG. 11 shows a side view of a first stage of a second manufacturing sequence of a sand screen on a base pipe.
Figure 12:
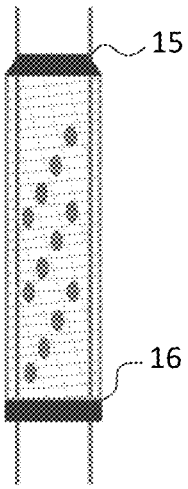
FIG. 12 shows a side view of a second stage of the second manufacturing sequence.
Figure 13:
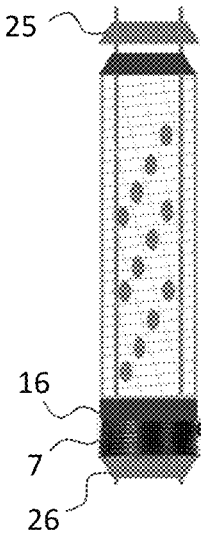
FIG. 13 shows a side view of a third stage of the second manufacturing sequence.

FIGS. 11 to 13 illustrate steps of a second manufacturing sequence. In this sequence, assembly of ribs 8 and screen wire(s) 9 are shrink-fit wrapped onto the perforated base pipe 1 prior to installing the end rings at the upper and lower extremities 5 and 6. The upper end ring 15 and lower end ring 16 are installed and connected to the ends of the ribs 8 and screen wire(s) 9 in FIG. 12, whereby the end rings 15 and 16 remain slidable on the base pipe 1. Subsequently, as shown in FIG. 13, the optional compliant shroud is installed on the lower end ring 16. The stationary upper stop ring 25 and lower stop ring 26 may be secured to the base pipe 1, for example by welding.

In either manufacturing sequence, it may be helpful to machine the outer diameter of the base pipe 1 in the areas of contact with the end rings 15 and 16, in order to enhance the sealability of the sand screen assembly against the base pipe 1.

It is expected that the overall compaction resistance can be improved by 50% by applying the features described above.

The present disclosure is not limited to the embodiments as described above and the appended claims. Many modifications are conceivable, and features of respective embodiments may be combined. The particular embodiments disclosed above are illustrative only, as the present invention may be modified, combined and/or practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined and/or modified and all such variations are considered within the scope of the present invention as defined in the accompanying claims.

We claim:

1. A downhole completion comprising a perforated base pipe having a central longitudinal axis, concentrically surrounded by a sand screen, said sand screen comprising an upper extremity and a lower extremity separated from each other in longitudinal direction, wherein at least one of the upper extremity and the lower extremity is slidable on the perforated base pipe;

further comprising two longitudinally separated stop rings configured to be secured to the perforated base pipe stationary thereto, wherein the sand screen is located between these stop rings with additional spacing in between the screen and at least one of the two stop rings, to allow for longitudinal slidability of one or both of the upper extremity and the lower extremity of the screen, wherein a gap between at least one of the lower extremity and the upper extremity and a nearest one of the two longitudinally separated stop rings is shielded off by a compliant shroud that allows longitudinal movement between the extremity and the stop ring.

2. The downhole completion of claim 1, wherein both the upper extremity and the lower extremity are slidable.

3. A downhole completion comprising a perforated base pipe having a central longitudinal axis, concentrically surrounded by a sand screen, said sand screen comprising an upper extremity and a lower extremity separated from each other in longitudinal direction, wherein at least one of the upper extremity and the lower extremity is slidable on the perforated base pipe, wherein the sand screen is a wire wrapped screen comprising a plurality of ribs surrounded by at least one screen wire wrapped around the ribs, further comprising a plurality of ribs extending between the upper extremity and the lower extremity along a helical rib path, wherein each screen wire follows a helical wire path having an opposite winding direction compared to the helical rib path.

4. The downhole completion of claim 3, wherein the wire wrapped screen is a direct wire-wrapped screen.

5. The downhole completion of claim 3, wherein the helical rib path has a rib helix angle in a first helix angle range of from 10° to 60° wherein helix angle is defined as smallest angle between the direction of a rib axis and the longitudinal direction.

6. The downhole completion of claim 5, wherein the helical wire path has a wire helix angle in a second helix angle range of from 30° to 80°.

7. The downhole completion of claim 6, wherein the first helix angle range is from 30° to 60° and the second helix angle range is from 30° to 60°.

8. The downhole completion of claim 7, wherein the helical wire path within the second helix angle range furthermore is about perpendicular to the rib axis at cross points between any rib and any screen wire, whereby any deviation from perpendicular is at most 20°, preferably at most 10°.

9. A downhole completion comprising a perforated base pipe having a central longitudinal axis, concentrically surrounded by a sand screen, said sand screen comprising an upper extremity and a lower extremity separated from each other in longitudinal direction, wherein at least one of the upper extremity and the lower extremity is slidable on the perforated base pipe, wherein the perforated base pipe is connected to a compaction compliance section, wherein the compaction compliance section comprises a corrugated wall section having corrugations in the longitudinal direction.

10. A downhole completion comprising a perforated base pipe having a central longitudinal axis, concentrically surrounded by a sand screen, said sand screen comprising an upper extremity and a lower extremity separated from each other in longitudinal direction, wherein at least one of the upper extremity and the lower extremity is slidable on the perforated base pipe, wherein the perforated base pipe is connected to a compaction compliance section, wherein the compaction compliance section comprises a telescopic section comprising two opposing pipe ends mutually slidable relative to each other in the longitudinal direction.

11. The downhole completion of claim 10, further comprising two longitudinally separated stop rings configured to be secured to the perforated base pipe stationary thereto, wherein the sand screen is located between these stop rings with additional spacing in between the screen and at least one of the two stop rings, to allow for longitudinal slidability of one or both of the upper extremity and the lower extremity of the screen.

12. The downhole completion of claim 11, wherein a gap between at least one of the lower extremity and the upper extremity and a nearest one of the two longitudinally separated stop rings is shielded off by a compliant shroud that allows longitudinal movement between the extremity and the stop ring.

13. The downhole completion of claim 10, wherein the sand screen is a wire wrapped screen comprising a plurality of ribs surrounded by at least one screen wire wrapped around the ribs.

14. The downhole completion of claim 13, further comprising a plurality of ribs extending between the upper extremity and the lower extremity along a helical rib path, wherein each screen wire follows a helical wire path having an opposite winding direction compared to the helical rib path.

15. The downhole completion of claim 14, wherein the helical rib path has a rib helix angle in a first helix angle range of from 10° to 60° wherein helix angle is defined as smallest angle between the direction of a rib axis and the longitudinal direction.

16. The downhole completion of claim 15, wherein the helical wire path has a wire helix angle in a second helix angle range of from 30° to 80°.

17. The downhole completion of claim 16, wherein the first helix angle range is from 30° to 60° and the second helix angle range is from 30° to 60°.

18. The downhole completion of claim 17, wherein the helical wire path within the second helix angle range furthermore is about perpendicular to the rib axis at cross points between any rib and any screen wire, whereby any deviation from perpendicular is at most 20°, preferably at most 10°.

19. The downhole completion of claim 13, wherein the wire wrapped screen is a direct wire-wrapped screen.

20. A method of manufacturing a downhole completion, comprising:

providing a perforated base pipe having a central longitudinal axis;

providing an assembly comprising a plurality of ribs extending between an upper extremity and a lower extremity along a helical rib path; and shrink-fit wrapping at least one screen wire on the plurality of ribs, along a helical wire path having an opposite winding direction compared to the helical rib path, while the assembly is concentrically arranged on the perforated base pipe whereby at least one, preferably both, of the upper extremity and the lower extremity are slidable on the perforated base pipe.

* * * * *